US007165648B2

(12) United States Patent
Arsdale

(10) Patent No.: US 7,165,648 B2
(45) Date of Patent: Jan. 23, 2007

(54) METHOD FOR CONTAINING AN ACOUSTICAL MATERIAL WITHIN AN ASSEMBLY

(75) Inventor: Kevin Van Arsdale, Swartz Creek, MI (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 274 days.

(21) Appl. No.: 10/874,117

(22) Filed: Jun. 22, 2004

(65) Prior Publication Data

US 2005/0279570 A1 Dec. 22, 2005

(51) Int. Cl.
*F01N 1/24* (2006.01)

(52) U.S. Cl. ..... 181/256; 181/252; 29/890.08; 156/73.1

(58) Field of Classification Search ..... 181/256, 181/212, 252; 29/890.08; 156/73.1
See application file for complete search history.

(56) References Cited

U.S. PATENT DOCUMENTS 4,569,471 A 2/1986 Ingemansson et al.
4,774,985 A * 10/1988 Broadbelt et al. ..... 141/12
4,824,507 A * 4/1989 D'Amico ..... 156/245
5,766,541 A 6/1998 Knutsson et al.
5,976,453 A 11/1999 Nilsson et al.
6,068,082 A * 5/2000 D'Amico et al. ..... 181/256
6,581,723 B1 * 6/2003 Brandt et al. ..... 181/256
6,607,052 B1 * 8/2003 Brandt et al. ..... 181/256
2001/0003624 A1 * 6/2001 Lind et al. ..... 428/516
2003/0042070 A1 * 3/2003 Brandt et al. ..... 181/256

* cited by examiner

*Primary Examiner*—Lincoln Donovan
*Assistant Examiner*—Forrest Phillips
(74) *Attorney, Agent, or Firm*—Inger H. Eckert; Margaret S. Millikin

(57) ABSTRACT

A method for containing fibrous material within muffler comprises the initial step of providing an internal assembly of a muffler. In the next method step, a sheet is placed about the internal assembly to form an enclosure about a compartment. In the next method step, the compartment is filled with a fibrous material. A muffler according to the invention comprises a muffler having an outer shell having an internal cavity and outer edges. An internal assembly is inserted within the internal cavity. The internal assembly comprises partitions and a sheet about the internal assembly and extending between the partitions from an enclosure between the partitions. The enclosure is filled with fibrous material. End plates are joined to the outer edges of the outer shell.

20 Claims, 4 Drawing Sheets

METHOD FOR CONTAINING AN ACOUSTICAL MATERIAL WITHIN AN ASSEMBLY

TECHNICAL FIELD AND INDUSTRIAL APPLICABILITY OF THE INVENTION

This invention relates in general to acoustical insulation or damping products and in particular, to acoustical insulation or damping products that are particularly suitable for use in containers through which gas flows. Most particularly, the invention relates to a process for containing acoustical insulation or damping material within a motor vehicle muffler assembly and an apparatus produced thereby.

BACKGROUND OF INVENTION

It is well known that conventional motor vehicle mufflers include a container defining an inner space or cavity that is filled with an acoustical insulation or damping material. Most often, the material is glass fiber material. The motor vehicle muffler is filled with the aid of pneumatic devices, which generally comprise heavy pipes and powerful fans.

U.S. Pat. No. 4,569,471, to Ingemansson et al., the disclosure of which is incorporated herein by reference, discloses a process and apparatus for feeding lengths of a continuous glass fiber strand into an outer shell of a muffler. The apparatus includes a texturizing device with a nozzle for expanding the continuous glass fiber strand into a wool-like material before the wool-like material enters the outer shell. In a first embodiment of the invention, the filling of an outer cylinder of the muffler outer shell occurs without an end-piece joined to the outer cylinder. After the filling operation is completed, the outer cylinder is moved to a separate station where the end piece is welded onto the outer cylinder. In a second embodiment of the invention, a perforated pipe/outer end piece assembly is located only part way in the outer cylinder during the filling operation. After the filling operation has been completed, the perforated pipe/outer end piece assembly is moved to its final position within the outer cylinder.

The aforementioned process is typically not used with clam shell mufflers comprising first and second halves which, when coupled together and enclosing a perforated pipe, may not have an open end through which insulation or damping material may be fed.

It is also known in the prior art to form preforms from glass fiber material which are adapted to be inserted into a first muffler shell section prior to its being coupled to a corresponding second muffler shell section. An example of a prior art preform is disclosed in U.S. Pat. No. 5,766,541, to Knutsson et al., the disclosure of which is incorporated herein by reference. While such preforms are acceptable in performance, they add additional cost to the muffler due to the manufacturing steps necessary to form the preforms.

It is also known to fill a mesh or bag with fibrous material. The mesh or bag is then inserted into a first muffler shell section prior to the first muffler shell section's being coupled to a second muffler shell section. An example of such a bag is disclosed in U.S. Pat. No. 6,068,082, to D'Amico, Jr. et al., the disclosure of which is incorporated herein by reference. Such bags are filled in a semi-automatic machine and then sealed by heat in a manual operation. To seal the bag after being filled, an operator has to make sure that no fibrous material (i.e., filaments) are present between the layers of the bag where the seal is to be made. Otherwise the seal may be compromised.

There is a need for an improved, low-cost process that can be used to fill a muffler shell.

SUMMARY OF INVENTION

The above need is met by the present invention, wherein a process is provided for containing acoustical insulation or damping material within a motor vehicle muffler assembly. The process comprises the initial step of providing an internal assembly of a muffler. In the next method step, a sheet is placed about the internal assembly to form an enclosure about a compartment. In the next method step, the compartment is filled with a fibrous material.

The present invention is further directed to a muffler comprising a muffler having an outer shell having an internal cavity and outer edges. An internal assembly is inserted within the internal cavity. The internal assembly comprises partitions and a sheet about the internal assembly and extending between the partitions to form an enclosure about a compartment. The compartment is filled with fibrous material. End plates are joined to the outer edges of the outer shell.

Various objects and advantages of this invention will become apparent to those skilled in the art from the following detailed description of the preferred embodiment, when read in light of the accompanying drawings.

DETAILED DESCRIPTION

Figure 1:
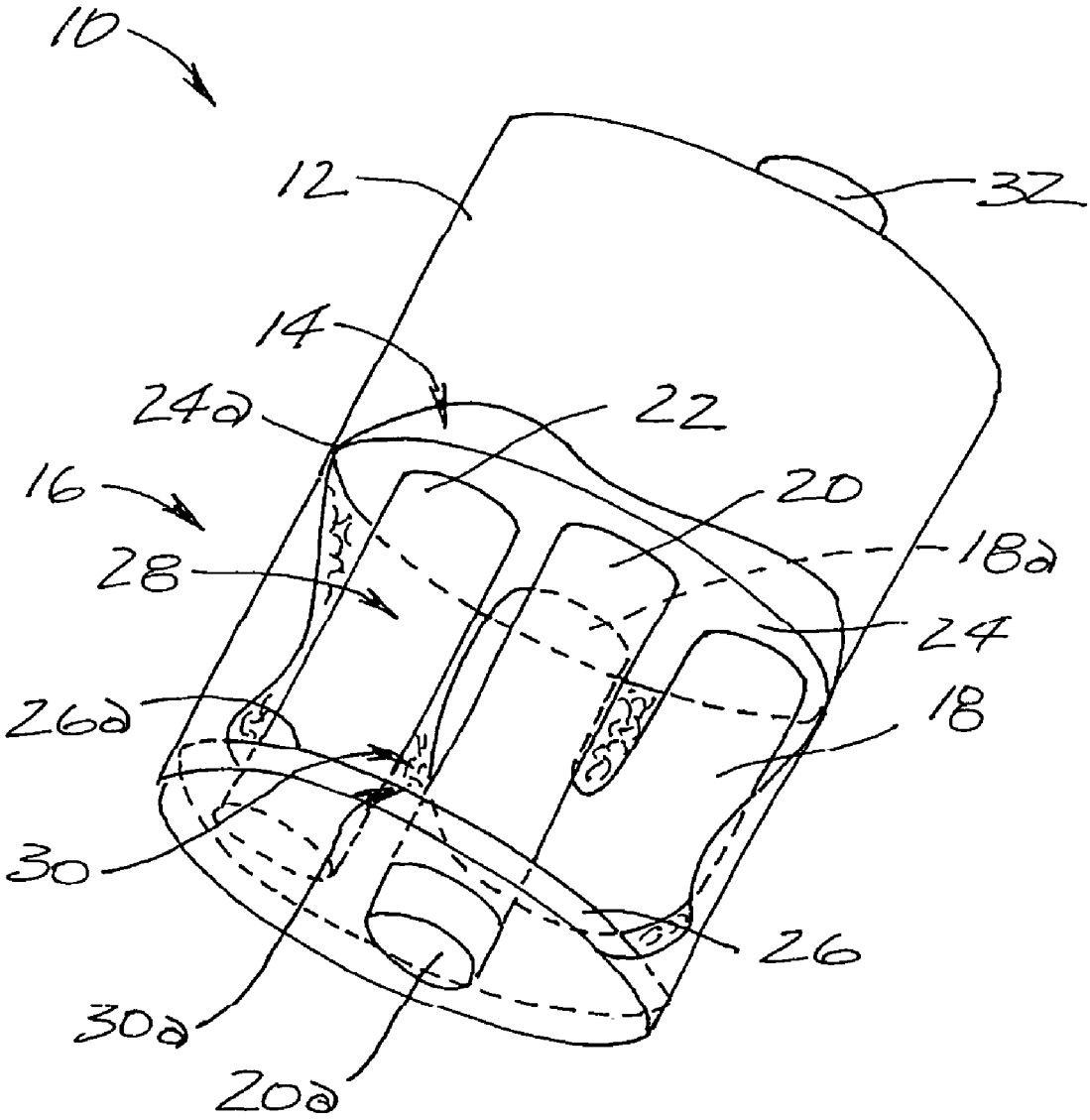
FIG. 1 is a partially broken away, perspective view of a muffler filled with fibrous material in accordance with the present invention.

Referring now to the drawings, there is illustrated in FIG. 1 a muffler 10 filled with fibrous material in accordance with the present invention. The muffler 10 comprises an outer shell 12, which can be any suitable form, such as the canister shown, or a clam-shell comprising first and second muffler shell outer parts (not shown). The outer shell 12 defines a shell internal cavity 14. An internal assembly 16 is provided in the shell internal cavity 14. In the illustrated embodiment, the internal assembly 16 comprises a generally U-shaped perforated pipe 18, a perforated through pipe 20, a non-perforated through pipe 22, and a plurality of partitions, such as the first and second partitions 24 and 26 shown. The pipes 18, 20 and 22 can be joined to the partitions 24 and 26 by a mechanical lock (e.g., by being swaged) or by a conventional welding operation. The partitions 24 and 26 define one or more compartments, such as the compartment 28 shown, within the muffler 10 and may be perforated so as to permit gases to pass therethrough. As will be discussed further below, the shell internal cavity 14 is filled with fibrous material 30, which defines a wool-type product 30*a* within the internal cavity 14.

A first exhaust pipe (not shown) extending between a vehicle engine and the muffler 10 is coupled to the inlet pipe 32, which may be connected to an inlet portion 18*a* of the U-shaped perforated pipe 18. A second exhaust pipe (not shown) is coupled to an exit portion 20*a* of the perforated through pipe 20. During operation of a vehicle to which the muffler 10 is attached, exhaust gases pass into the muffler via the first exhaust pipe. Acoustic energy generated by those gases passes through and from the perforated pipe 18 to the wool-type product 30*a* which functions to dissipate a portion of that acoustic energy.

Figure 2:
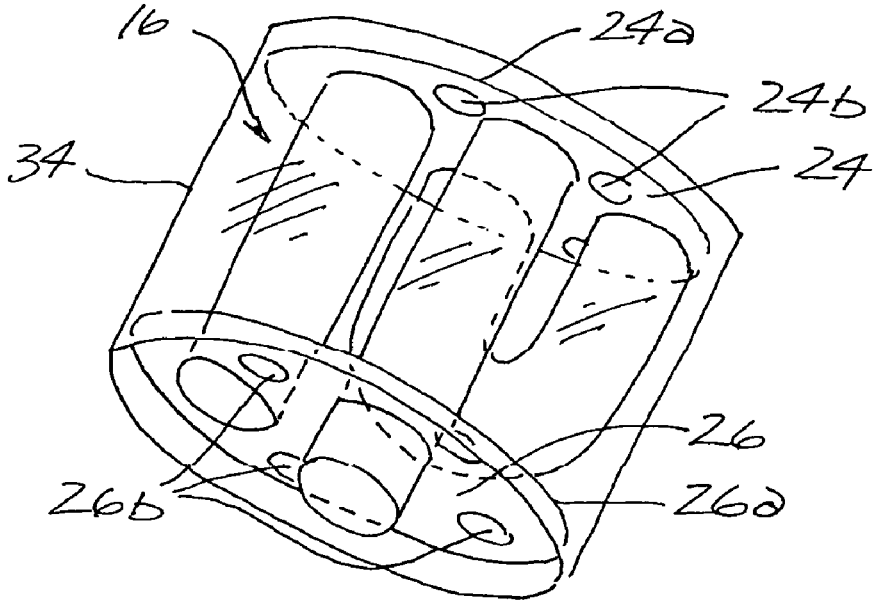
FIG. 2 is a perspective view of a sheet positioned about an internal assembly of the muffler.
Figure 3:
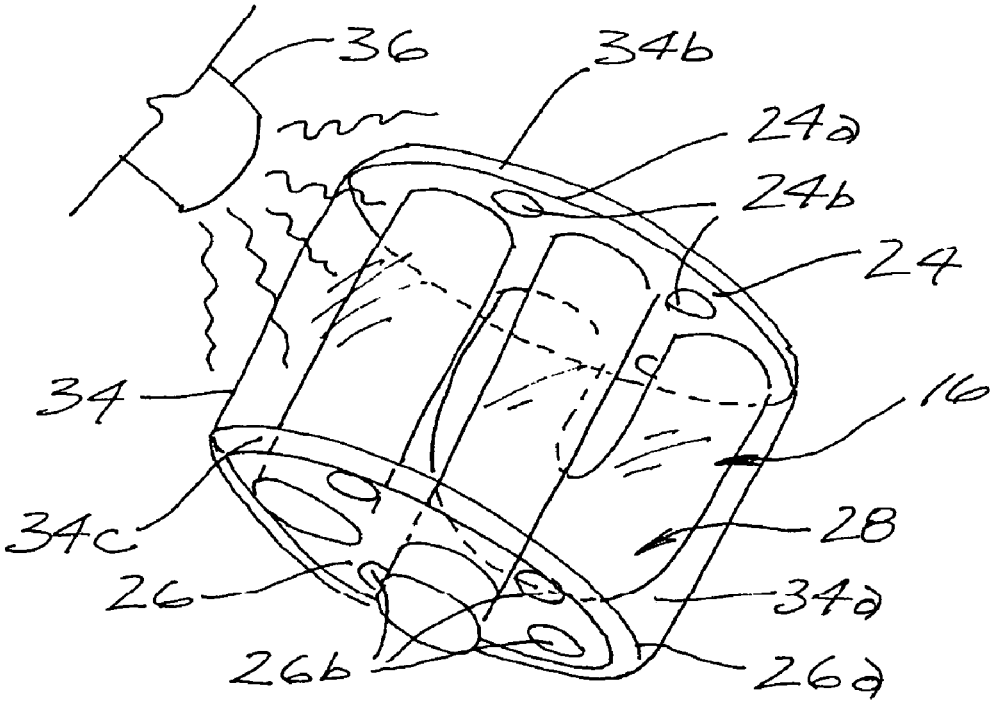
FIG. 3 is a perspective view of the sheet shrunk about the internal assembly of the muffler to form a temporary enclosure about a compartment.

The muffler outer shell 12 may be of any conventional and suitable shape. Further, the internal assembly 16 may comprise one or more perforated pipes; one or more non-perforated pipes coupled to one or more perforated pipes; or one or more perforated elements, such as a triangular, rectangular or other geometric shaped element coupled to one or more perforated or non-perforated pipes. It is also contemplated that the internal assembly 16 may include more than two partitions. An initial step in the process for filling a muffler 10 with fibrous material 30 involves placing a sheet 34 about the internal assembly 16, as shown in FIG. 2. The sheet 34 preferably comprises a heat shrinkable film, and preferably a polyolefin film, or some other heat shrinkable film that burns clean. Alternatively, the sheet 34 may be any suitable material, including an elastomeric film, which is not a heat shrinkable material. It is noted that the sheet 34 may be a shrink wrap film (e.g. polyethylene), an elastomeric film (e.g. a co-polymer of butadiene, such as polymethylmethacrylate-butadiene) or any other type of polymeric sheet (polyolefin or other type of material). The film would form the outer shell of the enclosure. The sheet 34 is sized within a close tolerance of the internal assembly 16 so as to fit closely about the peripheral edges 24*a* and 26*a* of the partitions 24 and 26. With a heat source 36 activated, the sheet 34 is then shrunk such that the sheet 34 is drawn inwardly against the internal assembly 16 to provide a temporary enclosure 34*a* about the compartment 28, as shown in FIG. 3. In the illustrated embodiment, the sheet 34 is either not perforated or includes only a very limited area having perforations. So as to provide access to the compartment 28 by the fibrous material 30 during a subsequent fibrous material filling operation, to be discussed below, one or more openings 24*b* and 26*b*, the number and size of which will be apparent to one skilled in the art, are provided in either or both of the partitions 24 and 26. These openings 24*b* and 26*b* provide sufficient pathways through which the fibrous material 30 may be added to the compartment 28 within the temporary enclosure 34*a* during a filling operation. As is apparent from FIG. 3, the sheet 34 extends between the peripheral edge 24*a* and 26*a* of each partition 24 and 26 and excess end portions 34*b* and 34*c* of the sheet 34 extend beyond the peripheral edge 24*a* and 26*a* of each partition 24 and 26. It is contemplated that the internal assembly 16 fits tightly within the shell internal cavity 14 of the outer shell 12 so that excess end portions 34*b* and 34*c* of the sheet 34 are cut off upon inserting the internal assembly 16 into the shell internal cavity 14 of the outer shell 12. Hence, metal-to-metal contact is achieved between the internal assembly 16 and the outer shell 12. It is also contemplated that the sheet 34 may contain an additive to reduce frictional engagement between the outer shell 12 and the internal assembly 16 when the internal assembly 16 is inserted into the shell internal cavity 14 of the outer shell 12. The additive may be Erucamide (c22) or Oleamide (c18), and is well known as "slip". It is a migratory additive that is added to the film when it is extruded and "blooms" to the surface to create a "slip" layer.

The next step in the process involves filling the compartment 28 within the temporary enclosure with the fibrous material 30. The perforation in the perforated U-shaped pipe 18 and the perforated through pipe 20 are sufficiently small to prevent the fibrous material 30 from entering into the pipes 18 and 20 during the fibrous filling operation and later, during use of the muffler 10.

Figure 4:
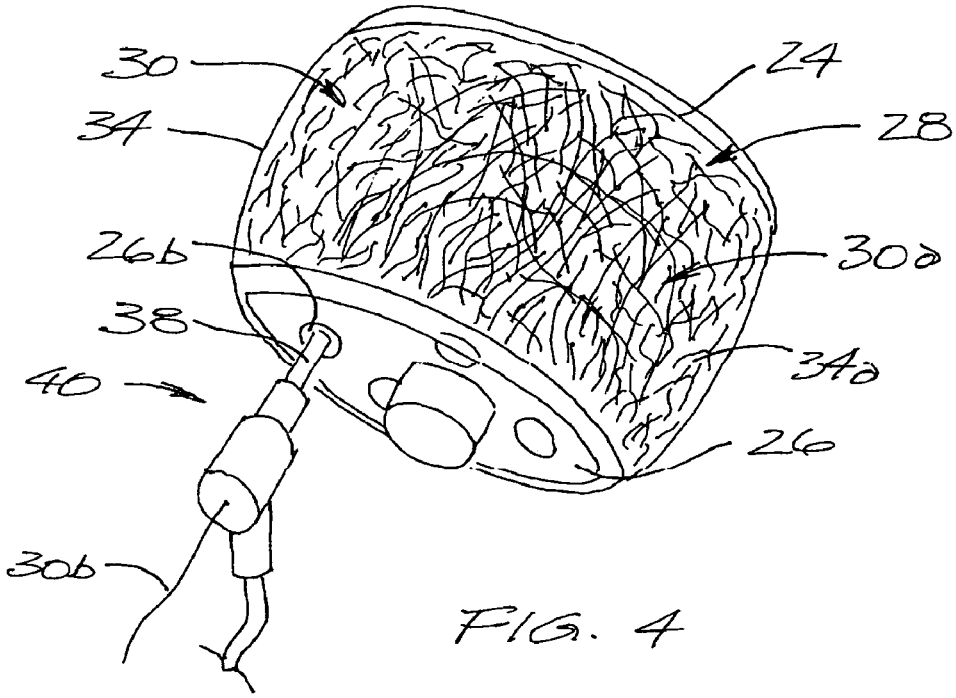
FIG. 4 is a perspective view of the compartment being filled with fibrous material.

To fill the compartment 28, a nozzle 38 of a conventional texturizing device 40 is positioned adjacent to or extended through the openings 24*b* and 26*b* in the partitions 24 and 26, as shown in FIG. 4. Such a device 40 is disclosed in U.S. Pat. Nos. 4,569,471 and 5,976,453, the disclosures of which are incorporated herein by reference. The fibrous material 30 may be formed from one or more continuous glass filament strands 30*b*, wherein each strand comprises a plurality of filaments. The filaments may be formed from E-glass or S-glass, or other glass compositions. For example, the continuous strand material 30*b* may comprise an E-glass roving sold by Owens Corning under the trademark ADVANTEX® or an S-glass roving sold by Owens Corning under the trademark Zen Tron®. It is also contemplated that a ceramic fibrous material, a mineral fibrous material, or some other material having acoustic properties, may be used instead of glass fibrous material. Pressurized air injected into the texturizing device 40 separates and entangles the filaments of the strand material 30*b* so that the strand material 30*b* emerges from the nozzle 38 as a continuous length of "fluffed-up" fibrous material. Once the fibrous material 30 fills the compartment 28, it defines a wool-type product 30*a* in that compartment 28. It is noted that the compartment 28 may be filled with a continuous pre-texturized fibrous material, such as texturized fibrous material sold by Owens Corning under the trademark ADVANTEX ST2000® or ADVANTEX ST1000®. It is also noted that that compartment 28 may be divided by inner partitions into sub-compartments (not shown), which may be filled with fibrous material 30 through openings in the inner partitions. Alternatively, one or more sub-compartments may be filled with fibrous material while the remaining sub-compartment or compartments are left unfilled. It is further noted that openings (not shown) may be provided in the sheet 34 instead of or in addition to the partitions 24 and 26 through which the compartment 28 may be filled with fibrous material 30.

A sufficient quantity of fibrous material 30 (for example, 90–120 grams/liter) is provided in the compartment 28 between the partitions 24 and 26 and enclosure 34*a* so as to allow the resultant muffler 10 to adequately perform its acoustic energy attenuation function.

Figure 5:
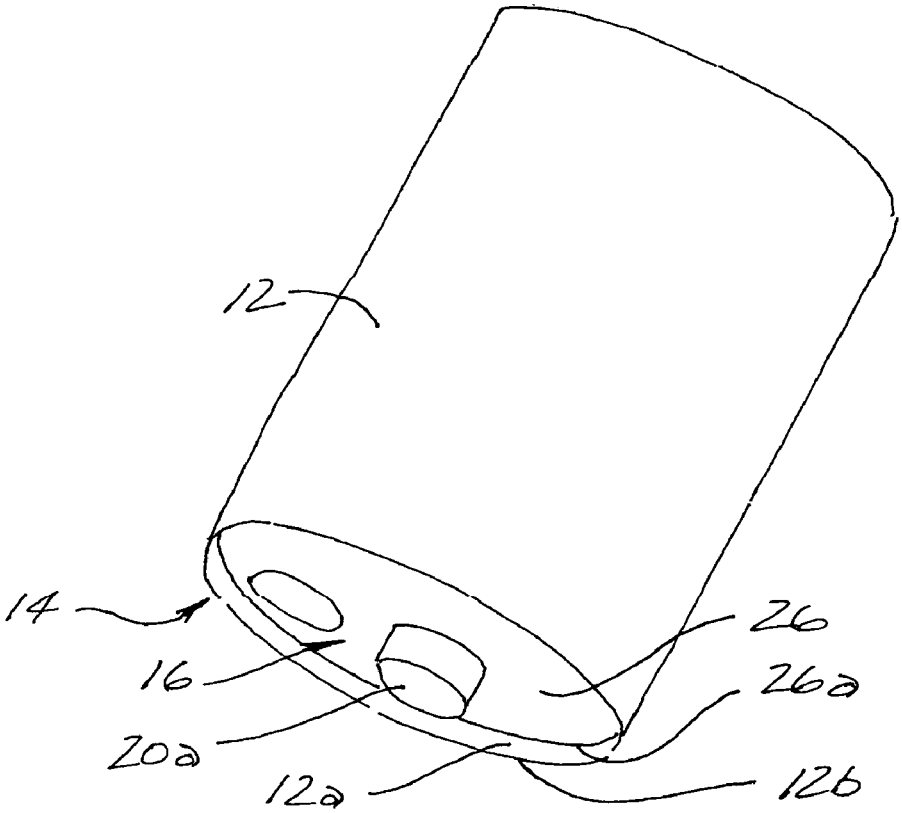
FIG. 5 is a perspective view of the internal assembly inserted into a shell internal cavity of a muffler outer shell.

The next step of the process involves assembling the muffler 10, wherein the internal assembly 16 is inserted into the shell internal cavity 14 of the muffler outer shell 12, as shown in FIG. 5. As stated above, the internal assembly 16 fits tightly within the shell internal cavity 14 of the outer shell 12. The tight fit between the internal assembly 16 and the outer shell 12 serves the mechanically hold the internal assembly 16 and the outer shell 12 together. It is noted that the internal assembly 16 may be joined to the outer shell 12 by a conventional welding operation.

Upon inserting the internal assembly 16 into the muffler outer shell 12, excess end portions 34*b* and 34*c* of the sheet 34 are cut off by contact between the peripheral edges 24*a* and 26*a* of the partitions 24 and 26 and the inner surface 12*a* of the muffler outer shell 12. In the illustrated embodiment, the exit portion 20*a* of the perforated through pipe 20 extends beyond the outer edge 12*b* of the muffler outer shell 12, with the internal assembly 16 residing well within the edge 12*b* of the muffler outer shell 12.

Figure 6:
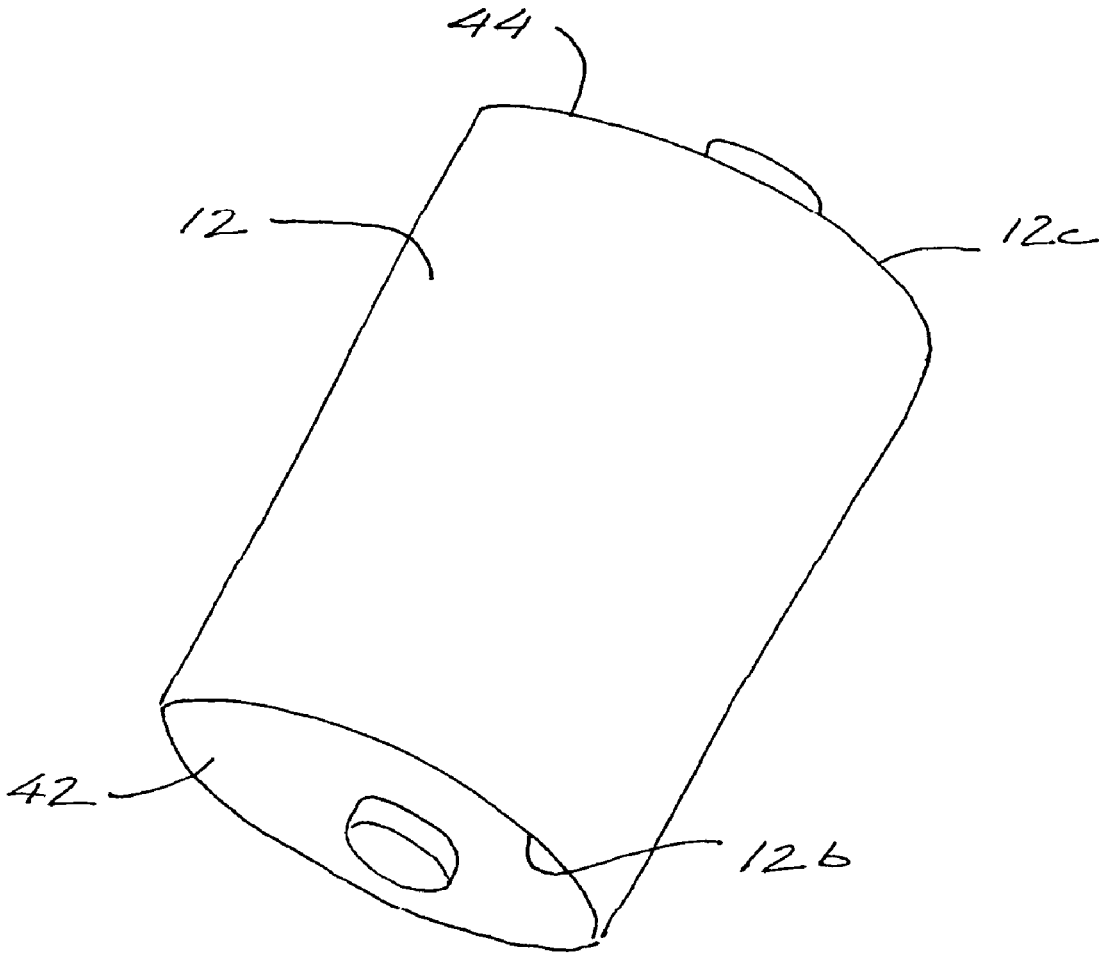
FIG. 6 is a perspective view of end plates joined to outer edges of the muffler outer shell part.

With the internal assembly 16 within the muffler outer shell 12, end plates 42 and 44 are joined to the outer edges 12*b* and 12*c* of the muffler outer shell part 12, as shown in FIG. 6. The end plates 42 and 44 may be joined to the outer edges 12*b* and 12*c* of the muffler outer shell part 12 by a mechanical lock, such as a conventional flange crimping operation. Alternatively, the end plates 42 and 44 may be joined to the outer edges 12*b* and 12*c* of the muffler outer shell part 12 by a conventional welding operation.

It is noted that the term "muffler", as used throughout the specification and claims, is intended to include mufflers, resonators, silencers, catalytic converters and like devices.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A method for containing fibrous material within a muffler comprising the steps of:

a) providing an internal assembly of a muffler, wherein the internal assembly includes partitions;

b) placing a sheet about the internal assembly, the sheet extending between at least two of the partitions, whereby the sheet and the partitions form an enclosure about a compartment, whereby the internal assembly is enclosed within the compartment; and c) filling the compartment with a fibrous material.

2. The method of claim 1, wherein the sheet is a shrink wrap film.

3. The method of claim 2, further comprising the step of activating a heat source to shrink the shrink wrap film.

4. The method of claim 1, wherein the sheet is an elastomeric film.

5. The method of claim 1, wherein the sheet is a polymeric sheet.

6. The method of claim 1, wherein the internal assembly has partitions, one or more of which has one or more openings therethrough to provide pathways through which the fibrous material may be added to the compartment.

7. The method of claim 1, wherein the internal assembly has partitions with peripheral edges and the sheet fits closely about the peripheral edges of two or more of the partitions.

8. The method of claim 1, wherein the internal assembly has partitions with peripheral edges, and wherein the sheet extends between the two or more partitions and an excess end portion of the sheet extends beyond the peripheral edge of one or more partitions.

9. The method of claim 8, further comprising the step of inserting the internal assembly within an internal cavity of a muffler outer shell, and wherein the internal assembly fits tightly within the internal cavity so tat the excess end portion of the sheet extending beyond the peripheral edge of the one or more partitions is cut off upon inserting the internal assembly into the shell internal cavity.

10. The method of claim 1, further comprising the step of inserting the internal assembly within an internal cavity of a muffler outer shell, and wherein the sheet contains an additive to reduce frictional engagement between the internal assembly and the outer shell when the internal assembly is inserted into the internal cavity of the outer shell.

11. The method of claim 1, wherein the internal assembly has partitions and one or more openings are in at least one of the partitions to provide a pathway for filling the compartment with the fibrous material.

12. The method of claim 11, wherein step d) comprises the step of adding fibrous material through the one or more openings by a nozzle of a texturizing device.

13. The method of claim 1, wherein the fibrous material is formed from one or more continuous glass filament strands, wherein each strand comprises a plurality of filaments.

14. The method of claim 1, wherein the fibrous material is a mineral fibrous material.

15. The method of claim 1, further comprising the step of assembling a muffler, wherein the enclosed internal assembly, with the sheet thereabout forming the enclosure about the compartment and about the fibrous material in the compartment, is inserted into an internal cavity of a muffler outer shell.

16. The method of claim 15, wherein the internal assembly fits tightly within the internal cavity of the outer shell.

17. The method of claim 15, further comprising the step of joining one or more end plates to one or more outer edges of the muffler outer shell.

18. A muffler comprising:

an outer shell having an internal cavity and outer edges;

an internal assembly inserted within the internal cavity, the internal assembly comprising partitions;

a sheet about the internal assembly and extending between at least two of the partitions whereby the sheet and the partitions form an enclosure about a compartment and the internal assembly, and fibrous material within the compartment; and one or more end plates joined to the outer edges of the outer shell.

19. The muffler of claim 18, wherein the sheet is a shrink wrap film that is shrunk about the internal assembly.

20. The muffler of claim 18, wherein the sheet is one or more of an elastomeric or a polymeric material.

* * * * *